US011273543B2

(12) United States Patent
Spazzadeschi et al.

(10) Patent No.: US 11,273,543 B2
(45) Date of Patent: Mar. 15, 2022

(54) INSTALLATION TOOL FOR CLAMPING RINGS

(71) Applicant: MollFAM S.r.l., Cornaredo (IT)

(72) Inventors: ILario Spazzadeschi, Cornaredo (IT); Enrico Spazzadeschi, Cornaredo (IT); Riccardo Spazzadeschi, Cornaredo (IT)

( * ) Notice: Subject to any disclaimer, the term of this patent is extended or adjusted under 35 U.S.C. 154(b) by 148 days.

(21) Appl. No.: 16/572,795

(22) Filed: Sep. 17, 2019

(65) Prior Publication Data

US 2020/0094386 A1 Mar. 26, 2020

Related U.S. Application Data

(60) Provisional application No. 62/735,264, filed on Sep. 24, 2018.

(51) Int. Cl.
*B25B 25/00* (2006.01)

(52) U.S. Cl.
CPC ..... *B25B 25/005* (2013.01)

(58) Field of Classification Search
CPC ..... B25B 13/14; B25B 13/28; B25B 13/30; B25B 13/32; B25B 17/00; B25B 17/02; B25B 23/0028; B25B 25/005; B25B 7/12; B25B 7/126; B25G 1/06; B25G 1/063; B25G 1/066; B26B 15/00; B41F 16/02
See application file for complete search history.

(56) References Cited

U.S. PATENT DOCUMENTS

| | | | | |
|---|---|---|---|---|
| 2,927,373 A * | 3/1960 | Taube | A01G 3/037 | 30/247 |
| 7,207,233 B2 * | 4/2007 | Wadge | B25F 5/02 | 74/412 R |
| 8,261,453 B2 * | 9/2012 | Huang | B26B 15/00 | 30/92 |
| 2007/0144753 A1 * | 6/2007 | Miller | B25F 5/026 | 173/217 |

* cited by examiner

*Primary Examiner* — Tyrone V Hall, Jr.
(74) *Attorney, Agent, or Firm* — Rumit Ranjit Kanakia

(57) ABSTRACT

An installation tool for installing and uninstalling lock rings, bolts, cable lugs, hose clamps is provided. The installation tool comprises a frame assembly and a driving member secured to the frame assembly. The installation tool also comprises a gear assembly operatively coupled to the frame assembly. The gear assembly comprises a plurality of gears which are configured to receive rotational input from the driving member. The installation tool further comprises a jaw assembly operatively coupled to the gear assembly and the frame assembly. The jaw assembly comprises a plurality of jaw members which are configured to receive rotational input from the gear assembly. The installation tool comprises an electronic control unit and an intuitive graphic interface having a touch display. The installation tool ensures precise closing position of the jaw assembly to the tenth of a millimeter.

18 Claims, 12 Drawing Sheets

INSTALLATION TOOL FOR CLAMPING RINGS

CROSS REFERENCE TO RELATED APPLICATIONS

The present invention claims priority under 35 United States Code, Section 119 on the provisional application No. 62/735,264 filed on Sep. 24, 2018, the disclosure of which is incorporated by reference.

FIELD OF THE INVENTION

The present invention generally relates power tools, and, more particularly, to a tool for installation or manipulation of clamping rings, locking rings, bolts, cable lugs, and hose clamps etc.

BACKGROUND OF THE INVENTION

Fastening elements, such as locking rings, bolts, cable lugs, hose clamps etc., are used in various fields and applications. For example, in automotive industry clamping rings are used for fixing flexible hoses on ridged nipples or for fastening bellows on universal shafts. Among other things, one of the most important factors that are required for successful installation of such clamping rings over the flexible hoses is whether or not the clamping rings are tightened with sufficient, but not excessive force, over the flexible hoses.

Installation tools of various kinds are employed for tightening of such clamping rings, locking rings, bolts, cable lugs, and hose clamps etc. Typically, the installation tools are either manually operated or pneumatically controlled. Among these, manually operated installation tools are more commonly used to tighten the clamping rings in the automotive industry. However, with such manually operated installation tools, whether the clamping ring is tightened with sufficient but not excessive force; entirely depends upon the skill and expertise of the mechanic operating the tool.

In order to preclude such dependence upon the skill and expertise of the mechanic, the pneumatically controller installation tools were introduced for the compression and clamping of locking rings, bolt, cable lugs, hose clamps, etc. However, the pneumatically controller installation tools also tend to have various disadvantages and limitations associated with them.

For example, compression force on the jaws of such installation tools is dependent, among other things, on a compressed air source to generate required compression forces. Moreover, the available state of technology in the pneumatically controller installation tools exhibits strong dispersions of the compression forces as it generally fails to not maintain its compression force at a constant pressure and they lose their compression force during the serviceable life due to which non-precise closing position may be reached, thereby defaulting the assembly or installations. Another disadvantage lies in the fact that the known pneumatically controller installation tools may not be maintenance free.

Accordingly, there is a need for installing/assembling or uninstalling/disassembling of locking rings, bolts, cable lugs, hose clamps, etc., to ensure precise closing position thereof, in such a way that the clamping rings are tightened with sufficient, but not excessive force, over the flexible hoses, without using the conventionally available pneumatically controller installation tools.

SUMMARY OF THE INVENTION

In view of the foregoing disadvantages inherent in the prior art, the general purpose of the present invention is to provide an installation tool to include all advantages of the prior art, and to overcome the drawbacks inherent in the prior art.

In one aspect of the present invention, an installation tool for installing and uninstalling lock rings, bolts, cable lugs, hose clamps is provided. The installation tool comprises a frame assembly and a driving member secured to the frame assembly. The installation tool also comprises a gear assembly operatively coupled to the frame assembly. The gear assembly comprises a plurality of gears which are configured to receive rotational input from the driving member. The installation tool further comprises a jaw assembly operatively coupled to the gear assembly and the frame assembly.

With this invention as disclosed above, the manual operation of the tools to clamp the clamp rings is eliminated. Further, the gear assembly along with the driving member provides the necessary rotational input to the jaw assembly to ensure that sufficient and not excessive force is generated within the jaw assembly.

In an embodiment, the frame assembly comprises a frame structure and at least one carrier member. The at least one carrier member is operatively coupled to the gear assembly and the jaw assembly, wherein the at least one carrier member is configured to pivotally rotate with respect to the frame structure. In an embodiment, the at least one carrier member is adapted to move up to 45 degrees with respect to the frame structure. The pivotal rotation of the carrier member with respect to the frame structure allows the installation tool to clamp the clamp rings which are disposed in hard to reach places.

In an embodiment, the driving member includes an electric motor controlled in a closed loop. In an embodiment, the driving member is electrically driven which is powered by a battery or low voltage power grid. The powers source and electric motor provides the necessary power required to operate the installation tool. As the electric motor is in closed loop system it ensures smooth operation of the installation tool. The electrically driven installation tool reduces and/or eliminates the maintenance issues which were predominant in conventional pneumatically controlled tools.

In an embodiment, the plurality of jaw members includes a first jaw member and a second jaw member, wherein the first jaw member and second jaw member are configured to move between an initial position and a final position. In an embodiment, the first jaw member comprises a first holding portion, a first pivotal portion, and a first tooth engaging portion. In an embodiment, the second jaw member comprises a second holding portion, a second pivotal portion, and a second tooth engaging portion. The jaw assembly in association with the gear assembly and the drive member generates the required force to clamp the clamp rings, thereby ensuring the clamp rings are tightened with sufficient, but not excessive force.

In an embodiment, the installation tool comprises an electronic control unit which is configured to control the driving member. The electronic control unit provided in the closed loop with the drive member ensures the precision of the tool and facilitates in generating the required power between the jaw members. The precision of the above disclosed installation tool is ensured up to the tenth of a millimeter.

In an embodiment, the plurality of gears includes a first horizontal gear member, a first vertical gear arrangement and a second vertical gear arrangement. The first horizontal gear member is rotatably coupled to the first vertical gear arrangement. Further, the first vertical gear arrangement is rotatably coupled to the second vertical gear arrangement. Moreover, the second vertical gear arrangement is coupled to the jaw assembly to transfer the rotational input from the driving member to the jaw assembly.

In an embodiment, the installation tool comprises an intuitive user interface which is in communication with the electronic control unit. The intuitive user interface is adapted to receive user input to control the driving member via the electronic control unit. In an embodiment, the intuitive user interface comprises a touch display. In an embodiment, the electronic control unit comprises preset clamping programs which may enable change in initial position and final position of the jaw assembly. The clamping programs are selected, or clamping cycles are created, using the intuitive graphic interface. The intuitive user interface provides a user-friendly interface to provide various options to user of the tool to select from various programs provided therein, according to the requirements.

In an embodiment, the installation tool further comprises a grip housing adapted to be grasped by a user for controlling the said tool. The grip housing encloses the driving member. The grip housing ensures easy handling of the tool.

In an embodiment, the gear assembly includes at least one rotational input member and at least one rotational output member. In an embodiment, the at least one rotational input member is a gear. The gear assembly provides the necessary rotation output required by the jaw assembly.

This together with the other aspects of the present invention, along with the various features of novelty that characterize the present invention, is pointed out with particularity in the claims annexed hereto and forms a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

The present invention provides an installation tool for installing and uninstalling lock rings, bolts, cable lugs, hose clamps is provided. The installation tool comprises a frame assembly and a driving member secured to the frame assembly. The installation tool also comprises a gear assembly operatively coupled to the frame assembly. The gear assembly comprises a plurality of gears which are configured to receive rotational input from the driving member. The installation tool further comprises a jaw assembly operatively coupled to the gear assembly and the frame assembly. The jaw assembly comprises a plurality of jaw members which are configured to receive rotational input from the gear assembly. The installation tool comprises an electronic control unit and an intuitive graphic interface having a touch display. The installation tool ensures precise closing position of the jaw members of the jaw assembly to the tenth of a millimeter. The precise closing of the jaw members of the jaw assembly ensures that force applied by the jaw members on to the lock rings, bolts, cable lugs, hose clamps etc., is sufficient, but not excessive.

Figure 1:
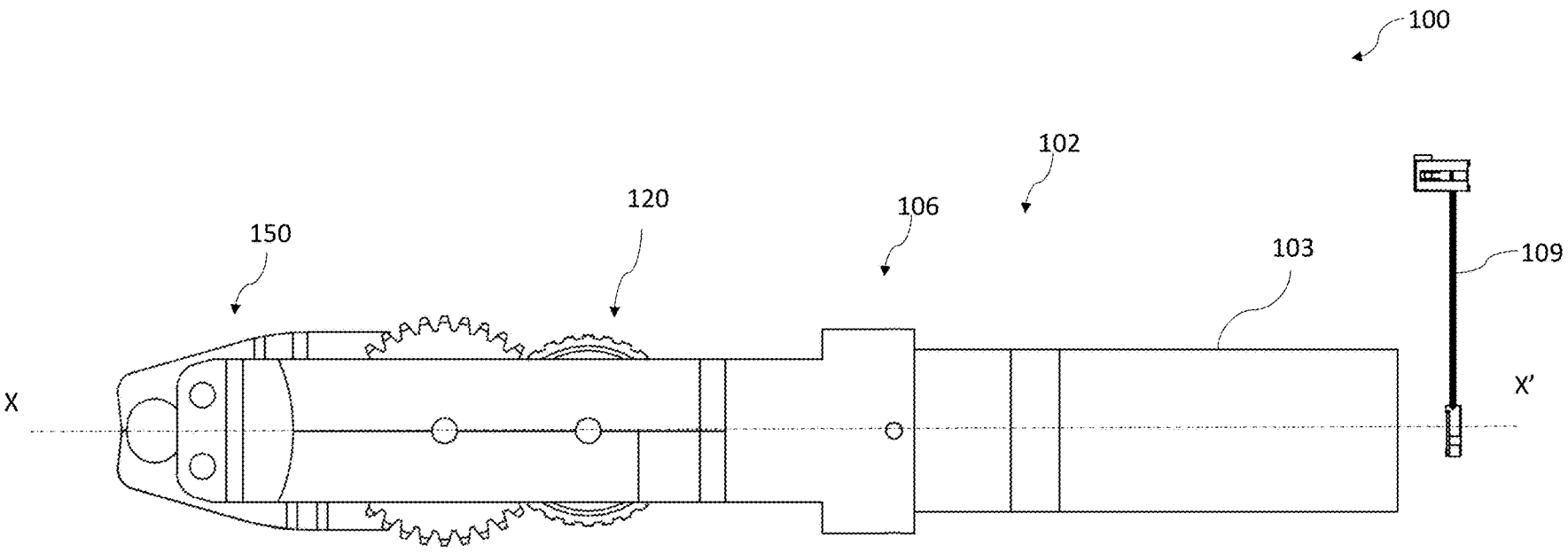
FIG. 1 illustrates a top view of an installation tool, in accordance with an embodiment of the present invention.

Referring to FIG. 1, an installation tool 100 is depicted. The installation tool 100 is used for operating, i.e. installing or uninstalling, various fastening elements, such as locking rings, bolts, cable lugs, hose clamps etc. The installation tool 100 comprises a handle assembly 102, a gear assembly 120, and a jaw assembly 150. The handle assembly 102 allows a user to hold the installation tool 100. The handle assembly 102 comprises a grip housing 103, a driving member 104

(shown in FIG. 4) and a frame assembly 106 coupled to each other along an axis X-X'. The driving member 104 is secured to the frame assembly 106. The driving member 104 is adapted to provide rotational force required by the installation tool 100. In the illustrated example, the driving member 104 embodies an electric motor which is controlled in a closed loop. The driving member 104 is electrically driven which is powered by a battery (not shown) or a low voltage power grid. In another example, the driving member 104 may embody a pneumatically powered member or hydraulically powered member, without limiting the scope of the invention. A cable 109 (as shown) is used to supply electrical power to the installation tool 100. In particular, the cable 109 is used to supply electrical power to the driving member 104 of the installation tool 100. A switch (not shown) is used to power on and power off the driving member 104.

Figure 4:
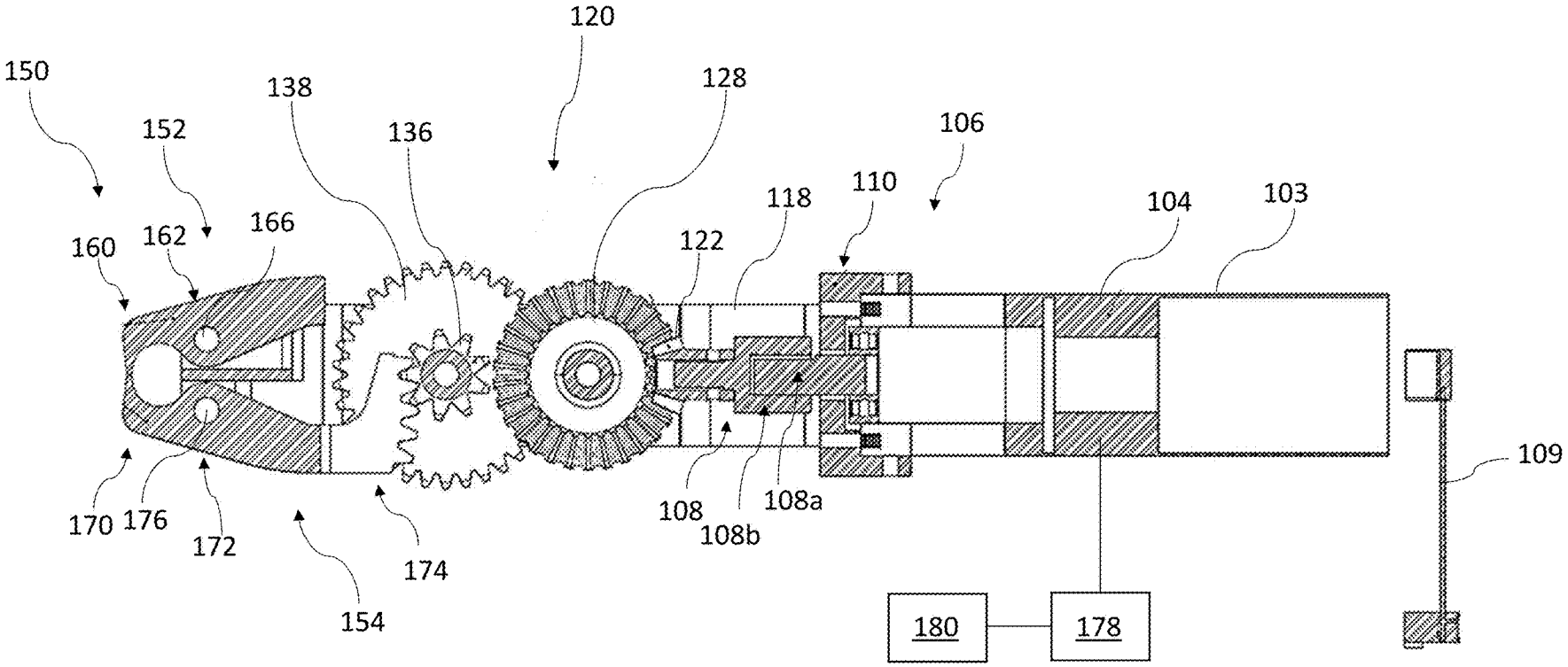
FIG. 4 illustrates a sectional view of the installation tool taken along the line A-A' of FIG. 3, in accordance with an embodiment of the present invention.

An output member 108 (shown in FIGS. 2 and 4) of the driving member 104 is adapted to transmit rotation and torque. As shown in FIG. 4, the output member 108 includes a driving shaft 108*a* and a driven shaft 108*b*, along the axis X-X' (shown in FIG. 1 and FIG. 5) to enable a drive line coupling therebetween. The driving shaft 108*a* and the driven shaft 108*b* are rotatably coupled to each other. The driving shaft 108*a* is coupled to the driving member 104 to be rotated by the driving member 104. The driven shaft 108*b* is rotatably engaged to the driving shaft 108*a* to be driven by the driving shaft 108*a* to transmit rotation and torque produced by the driving member 104. The output member 108 extends through the frame assembly 106. More particularly, the grip housing 103 encloses the driving member 104 and is secured to the frame assembly 106. In the illustrated example, the grip housing 103 is a hollow cylindrical member which facilitates easy handling of the installation tool 100. The grip housing 103 may comprise a plurality of grooves to facilitate additional grip to the user's fingers.

Figure 6:
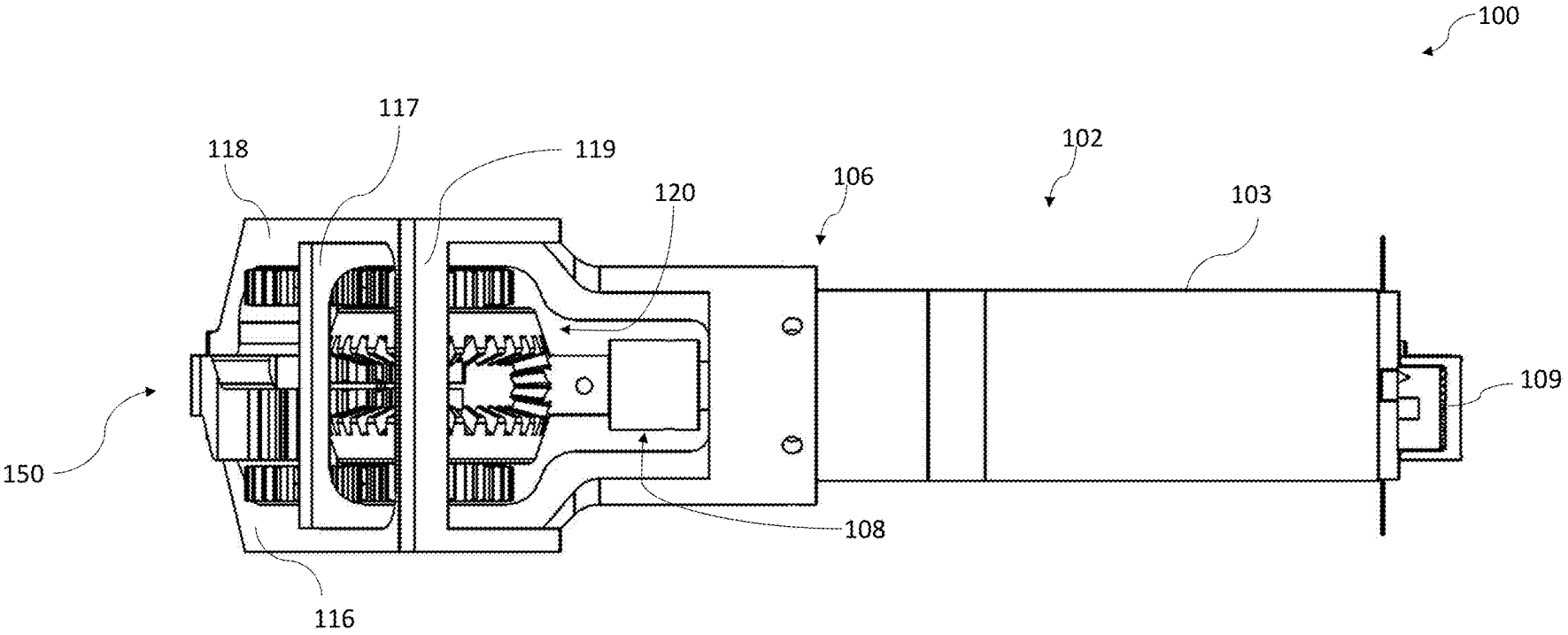
FIG. 6 illustrates a side view of the installation tool of FIG. 1 in the second position, in accordance with an embodiment of the present invention.
Figure 7:
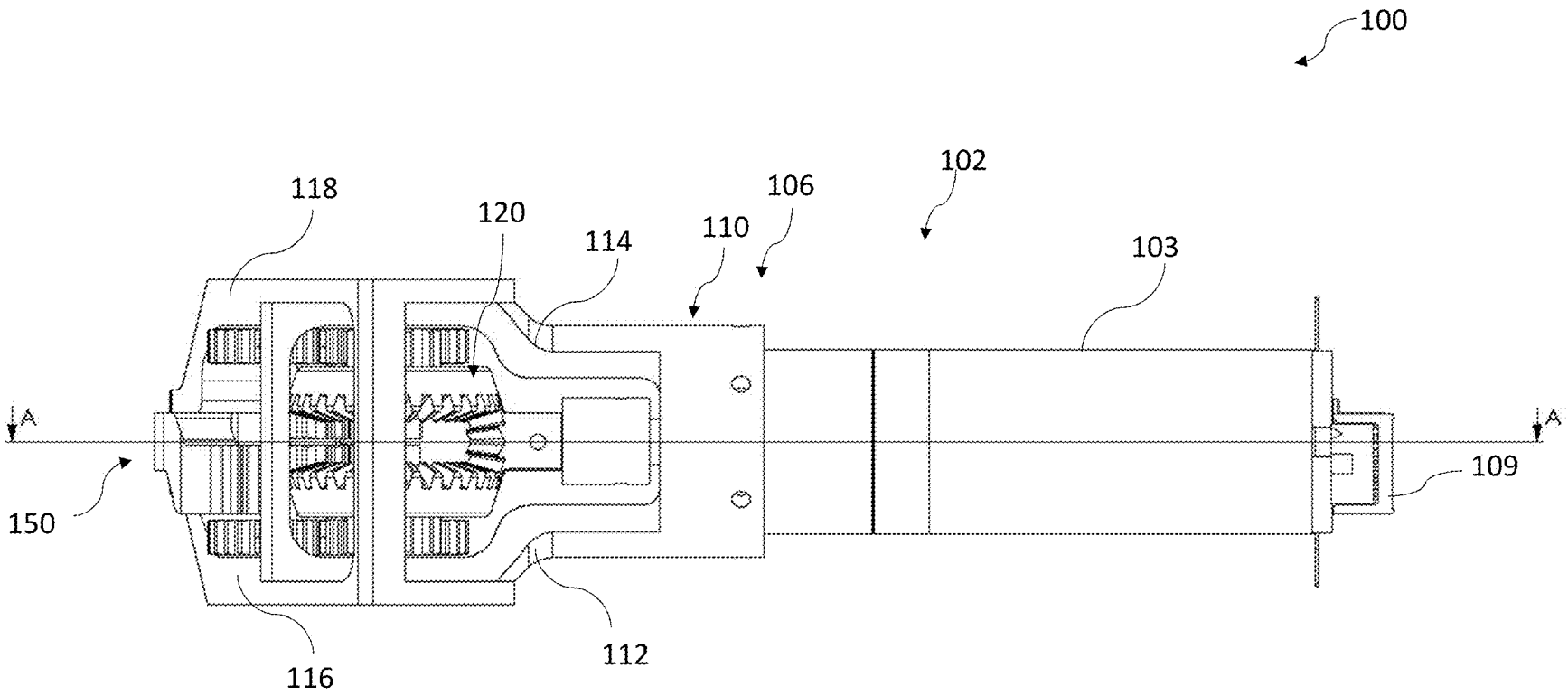
FIG. 7 illustrates a side view of the installation tool of FIG. 1 in the second position, in accordance with an embodiment of the present invention.
Figure 8:
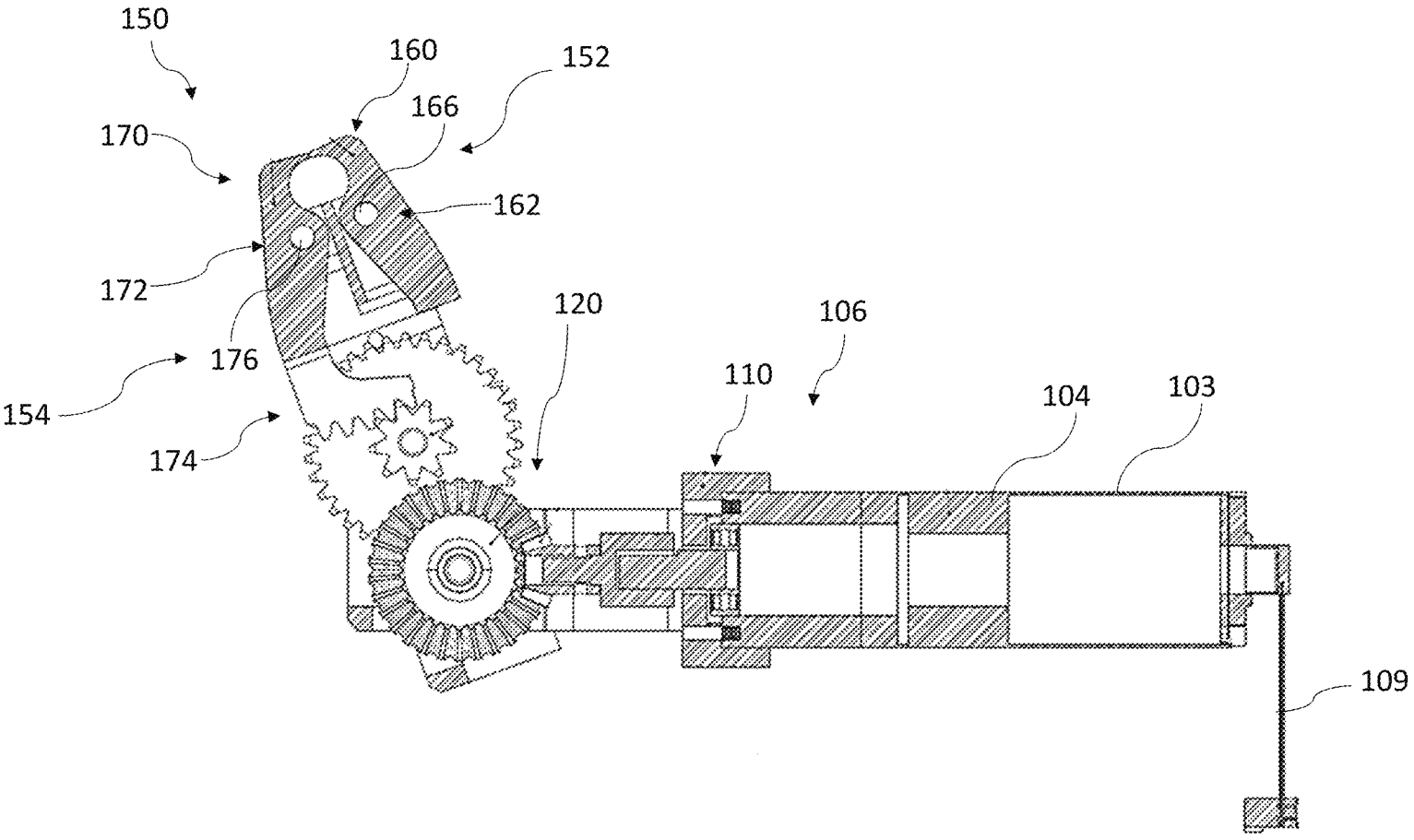
FIG. 8 illustrates a sectional view of the installation tool of FIG. 1 in the second position taken along the line A-A', in accordance with an embodiment of the present invention.

Referring to FIGS. 1 to 4, the frame assembly 106 is adapted to accommodate various parts of the installation tool 100. More particularly, the frame assembly 106 holds each of the jaw assembly 150, the gear assembly 120 and the driving member 104. The frame assembly 106 comprises a frame structure 110. The frame structure 110 comprises a plurality of frame members. In the illustrated example, the plurality of frame members includes a first frame member 112 and a second frame member 114. Further the frame assembly 106 comprises at least one carrier member. In the illustrated example, the frame assembly 106 comprises two carrier members, namely, a first carrier member 116 and a second carrier member 118. A plurality of cross members 117, 119 (shown in FIG. 6) may be disposed between the first carrier member 116 and the second carrier member 118, along the axis X-X'. The first carrier member 116 and the second carrier member 118 are disposed at a predetermined distance from one another. The first carrier member 116 is rotatably coupled to the first frame member 112, and the second carrier member 118 is rotatably coupled to the second frame member 114. The first carrier member 116 and the second carrier member 118 are adapted to rotate together, when either of the carrier members is moved relative to the frame members. The first carrier member 116 and the second carrier member 118 move substantially closer towards one another at front portion of the installation tool 100.

Referring to FIGS. 1 to 4, the gear assembly 120 of the installation tool 100 is operatively coupled to the frame structure 106. The gear assembly 120 is adapted to transmit the rotation received from the driving member 104 to the jaw assembly 150. The gear assembly 120 comprises a plurality of gears. As seen specifically in FIG. 2, the plurality of gears includes a first horizontal gear member 121, a first vertical gear arrangement 123 and a second vertical gear arrangement 131. The first horizontal gear member 121 is rotatable around the axis X-X'. Further, the first vertical gear arrangement 123 and the second vertical gear arrangement 131 are rotatable along respective axes perpendicular to the horizontal axis X-X'. The first horizontal gear member 121 is rotatably coupled to the first vertical gear arrangement 123. Further, the first vertical gear arrangement 123 is rotatably coupled to the second vertical gear arrangement 131. Furthermore, the second vertical gear arrangement 131 is coupled to the jaw assembly 150 to transfer the rotational input from the driving member 104 to the jaw assembly 150. In the illustrated example, the gear assembly 150 comprises nine gears such as a first gear 122, a second gear 124, a third gear 126, a fourth gear 128, a fifth gear 130, a sixth gear 132, a seventh gear 134, an eighth gear 136 and a ninth gear 138. Alternatively, the gear assembly 120 may comprises one or more than one gears, without limiting the scope of the invention. As such, the first horizontal gear member 121 comprises the first gear 122. The first vertical gear arrangement 123 comprises the second gear 124, the third gear 126, the fourth gear 128, and the fifth gear 130. Further, the second vertical gear arrangement 131 comprises the sixth gear 132, the seventh gear 134, the eighth gear 136, and the ninth gear 138.

Figure 5:
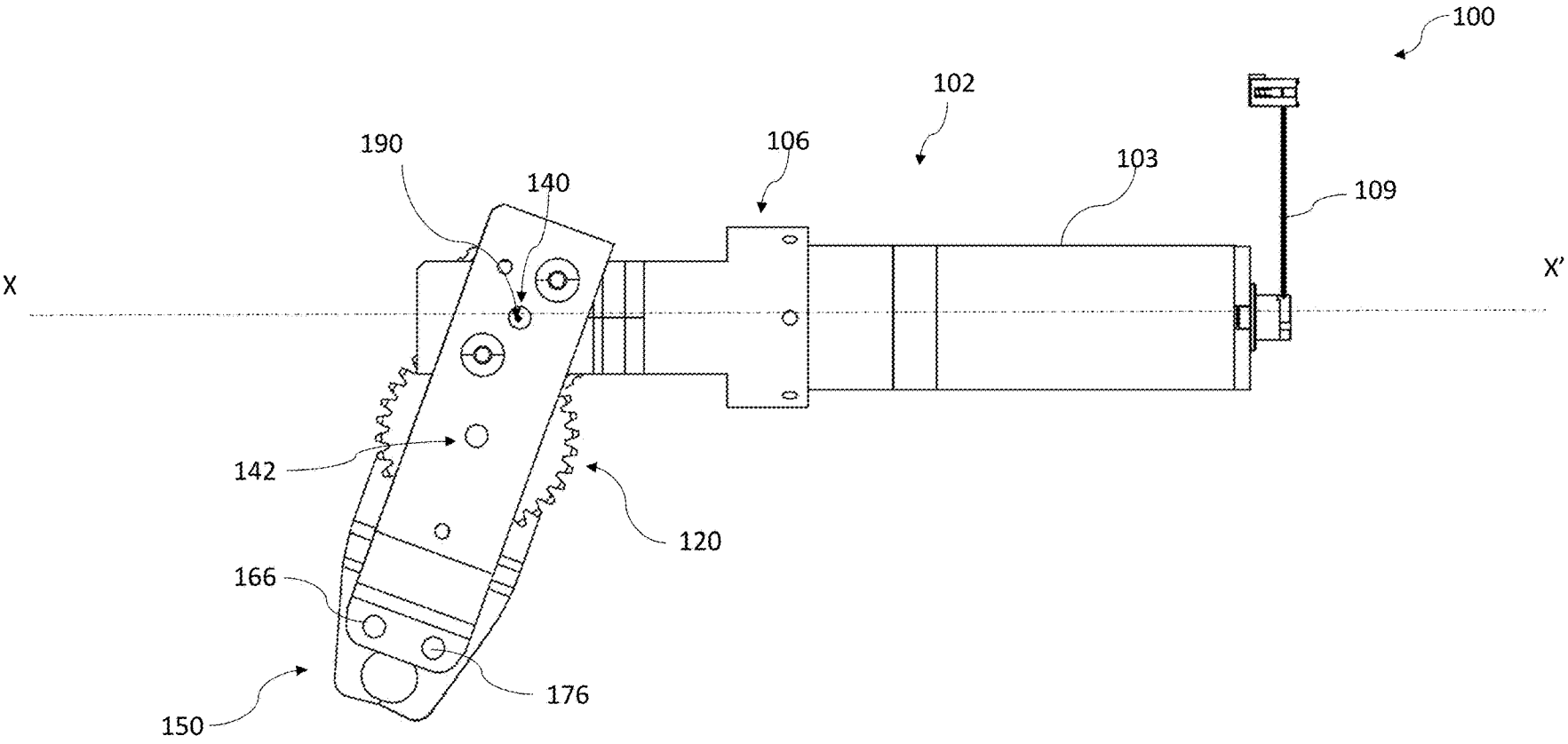
FIG. 5 illustrates a top view of the installation tool of FIG. 1 in a second position, in accordance with an embodiment of the present invention.

In the illustrated example, the first gear 122 embodies at least one rotational input receiving member of the gear assembly 120. The first gear 122 is coupled to the output member 108 driven by the driving member 104 to receive rotational input. In the illustrated example, the first gear 122 is coupled to the driven 108*b* of the output member 108, along the axis X-X', to be rotated by the driving member 104 via the driving shaft 108*a* to receive rotational input. In the illustrated example, the at least one rotational input receiving member is a bevel gear. The second gear 124, the third gear 126, the fourth gear 128 and the fifth gear 130 are disposed on a first pin member 140 (as seen in FIG. 5) extending between the first carrier member 116 and the second carrier member 118. The first pin member 140 is adapted to rotate along with the second gear 124, the third gear 126, the fourth gear 128 and the fifth gear 130. The second gear 124 and the third gear 126 are disposed adjacent to the first carrier member 116. The fourth gear 128 and the fifth gear 130 are disposed adjacent to the second carrier member 118.

In the illustrated example, the second gear 124 and the fourth gear 128 embody bevel gears. The second gear 124 and the fourth gear 128 are disposed along the first pin member 140 such that they are perpendicular to the axis X-X' and face one another. The second gear 124 and the fourth gear 128 are gearably coupled to the first gear 122, i.e. each of the second gear 124 and the fourth gear 128 is in mesh with the first gear 122 to transmit the rotational motion of the first gear 122 along the axis X-X' into a rotational motion along the first pin member 140, perpendicular to the axis X-X'. The second gear 124 and the fourth gear 128 are adapted to rotate as the first gear 122 rotates, when the first gear 122 receives rotational input from the output member 108 of the driving member 104. In the illustrated example, the third gear 126 and the fifth gear 130 embody spur gears. The third gear 126 is disposed between the second gear 124 and the first carrier member 116. The third gear 126 is adapted to rotate as the second gear 124 rotates. The fifth gear 130 is disposed between the fourth gear 128 and the second carrier member 118. The fifth gear 130 is adapted to rotate as the fourth gear 128 rotates.

In another example of the present invention, the second gear 124 and the third gear 126 are coupled to the first carrier member 116 via a first coaxial pin (not shown), the fourth gear 128 and the fifth gear 130 are coupled to the second carrier member 118 via a second coaxial pin (not shown). The first and second coaxial pins lie on the same axis and are adapted to rotate along with the gears mounted on it, without limiting the scope of the invention.

The sixth gear 132, the seventh gear 134, the eighth gear 136, and the ninth gear 138 are disposed on a second pin member 142, parallel to the second pin member 142 and perpendicular to the axis X-X', extending between the first carrier member 116 and the second carrier member 118. The second pin member 142 is adapted to rotate along with the sixth gear 132, the seventh gear 134, the eighth gear 136, and the ninth gear 138. In the illustrated example, the sixth gear 132, the seventh gear 134, the eighth gear 136, and the ninth gear 138 embody spur gears. The sixth gear 132 and the seventh gear 134 are disposed adjacent to the first carrier member 116. The sixth gear 132 is disposed between the seventh gear 134 and the first carrier member 116. The eighth gear 136 and the ninth gear 138 are disposed adjacent to the second carrier member 118. The ninth gear 138 is disposed between the eighth gear 136 and the second carrier member 118.

The sixth gear 132 is gearably coupled to the third gear 126, i.e. the sixth gear 132 is in mesh with the third gear 126. The ninth gear 138 is gearably coupled to the fifth gear 130, i.e. the ninth gear 138 is in mesh with the fifth gear 130. In the illustrated example, the seventh gear 134 and the eight gear 136 embodies the at least one rotational output members of the gear assembly 120.

In another example, the sixth gear 132 and the seventh gear 134 may be disposed on a coaxial pin different from the coaxial pin on which the eighth gear 136 and the ninth gear 138 are disposed, without limiting the scope of the invention.

Referring to FIGS. 1 to 8, the gear assembly 120 is operatively coupled to the jaw assembly 150. The jaw assembly 150 comprises a first jaw member 152 and a second jaw member 154. In the illustrated example, the first jaw member 152 and the second jaw member 154 are disposed between the first carrier member 116 and the second carrier member 118. The first jaw member 152 and the second jaw member 154 are configured to move between an initial position and a final position. In one example of the present invention, the first jaw member 152 and the second jaw member 154 are identical. In an example, the initial position of the first jaw member 152 and the second jaw member 154 may be defined as a position wherein the first jaw member 152 and the second jaw member 154 are at a predetermined maximum distance from one another, and the final position of the first jaw member 152 and the second jaw member 154 may be defined as a position wherein the first jaw member 152 and the second jaw member 154 are at a predetermined minimum distance from one another. All the position of the first jaw member 152 and the second jaw member 154, other than the first position and the final position, may be defined as an intermediate position.

In other words, when the first jaw member 152 and the second jaw member 154 are at the predetermined maximum distance from one another, it is called as an open position, and when the first jaw member 152 and the second jaw member 154 are at the predetermined minimum distance from one another, it is called a closed position. All the position of the first jaw member 152 and the second jaw member 154, other than the open position and the closed position, may be defined as an intermediate position of the first jaw member 152 and the second jaw member 154.

Figure 2:
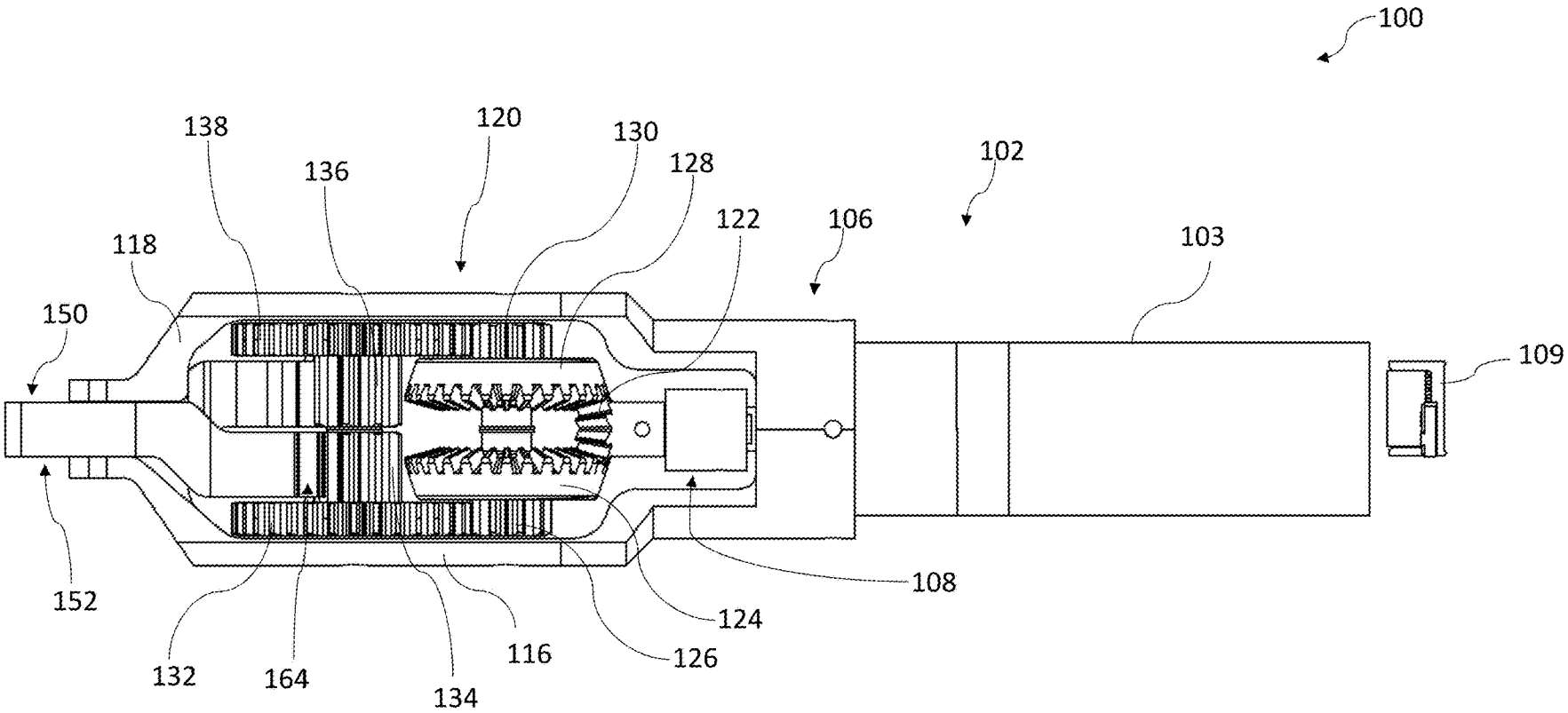
FIG. 2 illustrates a side view of the installation tool of FIG. 1, in accordance with an embodiment of the present invention.
Figure 3:
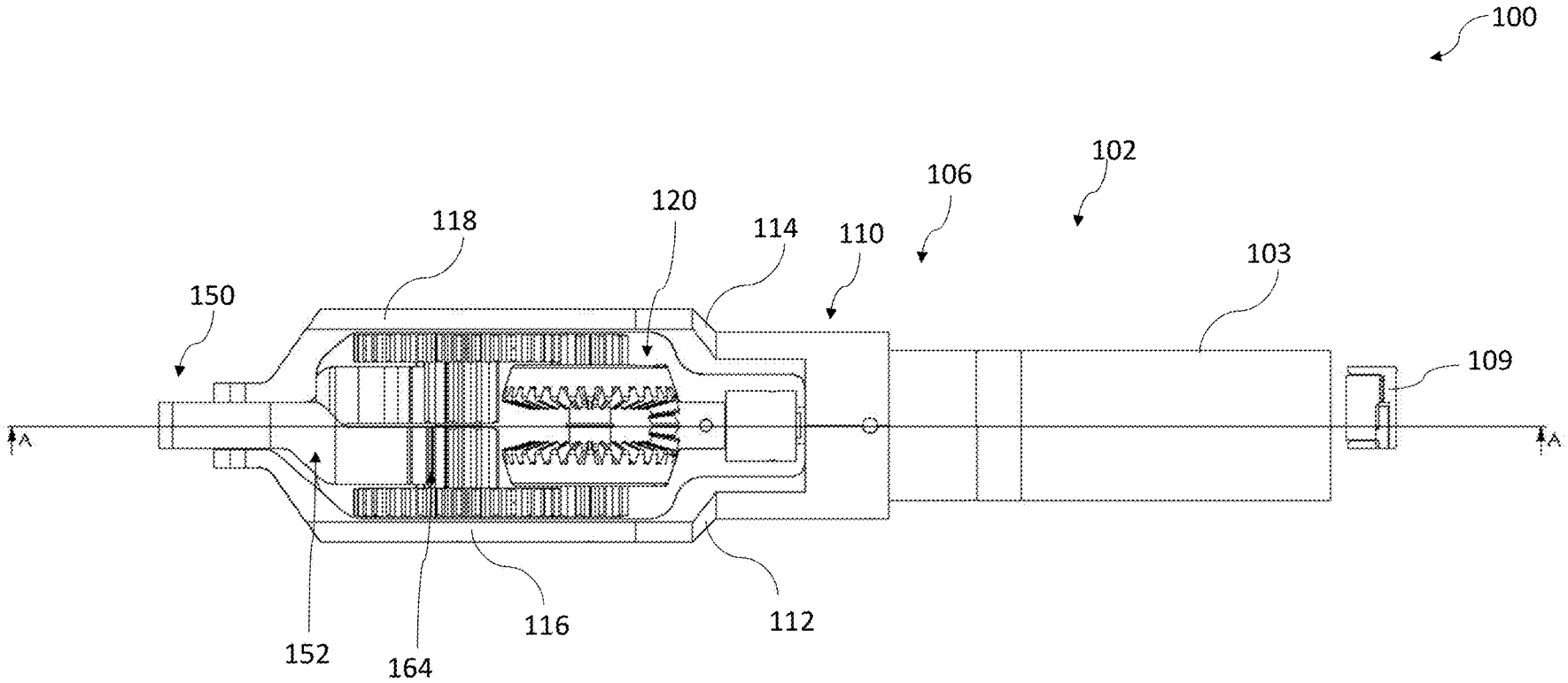
FIG. 3 illustrates a side view of the installation tool', in accordance with an embodiment of the present invention.

The first jaw member 152 comprises a first holding portion 160, a first pivotal portion 162, and a first toothed engaging portion 164 (as seen in FIG. 2). The first toothed engaging portion 164 is gearably coupled to the seventh gear 134 of the gear assembly 120, i.e. the first tooth engaging portion 164 is in mesh with the seventh gear 134. The first pivotal portion 162 is disposed adjacent to the first toothed engaging portion 164. The first pivotal portion 162 is coupled to the first carrier member 116 and the second carrier member 118 via a first pivot pin 166 (shown in FIGS. 4 and 5), parallel to the first and second pin members 140, 142 and perpendicular to a plane of axis X-X'. The first jaw member 152 is adapted to pivot about the first pivot pin 166. The first holding portion 160 is disposed adjacent to the first pivotal portion 162. The first jaw member 152 is adapted to pivot about the first pivot pin 166, based on the movement of the first toothed engaging portion 164 along the seventh gear 134 of the gear assembly 120. In one embodiment, the first toothed engaging portion 164 linearly moves along the seventh gear 134 of the gear assembly 120 to move the first holding portion 160 along the first pivotal portion 162.

The second jaw member 154 comprises a second holding portion 170, a second pivotal portion 172, and a second toothed engaging portion 174. The second toothed engaging portion 174 is gearably coupled to the eighth gear 136 of the gear assembly 120, i.e. the second tooth engaging portion 174 is in mesh with the eighth gear 136. The second pivotal portion 172 is disposed adjacent to the second toothed engaging portion 174. The second pivotal portion 172 is coupled to the first carrier member 116 and the second carrier member 118 via a second pivot pin 176 (shown in FIGS. 4 and 5), parallel to the first and second pin members 140, 142, and the first pivot pin 166, and perpendicular to a plane of axis X-X'. The second jaw member 154 is adapted to pivot about the second pivot pin 176. The second holding portion 170 is disposed adjacent to the second pivotal portion 172. The second jaw member 154 is adapted to pivot about the second pivot pin 176, based on the movement of the second toothed engaging portion 174 along the eighth gear 136 of the gear assembly 120. In one embodiment, the second toothed engaging portion 174 linearly moves along the eighth gear 136 of the gear assembly 120 to move the second holding portion 170 along the second pivotal portion 172

The first holding portion 160 and the second holding portion 170 are adapted to pivot about the first pivot pin 166 and the second pivot pin 176, respectively. More specifically, each of the first holding portion 160 and the second holding portion 170 are adapted to pivot about the first pivot pin 166 and the second pivot pin 176, respectively, to move between the initial position, any intermediate position and the final position. The first holding portion 160 and the second holding portion 170, in any of the initial position, intermediate position or the final position thereof, are adapted to clamp the clamping rings, locking rings, bolts, cable lugs, and hose clamps etc. In an embodiment, the first holding portion 160 and the second holding portion 170, in the final position thereof, are adapted to clamp the fastening elements, such as the clamping rings, locking rings, bolts, cable lugs, and hose clamps etc. The first holding portion 160 and the second holding portion 170 are adapted to generate a clamping force therebetween. In one example, the first holding portion 160 and the second holding portion 170 generates a clamping force up to 5 Kilo Newton (5 KN).

Referring to FIGS. 5 to 8, each of the first carrier member 116 and the second carrier member 118 are adapted to rotate with respect to the axis X-X' of the frame structure 110. In an embodiment, each of the first carrier member 116 and the second carrier member 118 are adapted to rotate up to an angle of 45 degrees with respect to the frame structure 110. In one example embodiment, each of the first carrier member 116 and the second carrier member 118 are adapted to rotate up to the angle of 45 degrees with respect to the frame structure 110 along the first pin member 140. In one example embodiment, a locking-unlocking member 190 may be engaged along the first pin member 140 to rotate each of the first carrier member 116 and the second carrier member 118 up to the angle of 45 degrees with respect to the frame structure 110 along the first pin member 140. In one further example embodiment, without departing from the scope of the present disclosure, each of the first carrier member 116 and the second carrier member 118 may also be adapted to rotate up to the angle of 45 degrees with respect to the frame structure 110 along the second pin member 142, and similar locking-unlocking pin 190 types may be used to lock and unlock the rotation. In one another arrangement, the first carrier member 116 and the second carrier member 118 may also be adapted to rotate up to the angle of 45 degrees with respect to the frame structure 110 from any other portion along the frame structure 110. Since the first carrier member 116 and the second carrier member 118 hold the jaw assembly 150, the jaw assembly 150 also rotates with respect to the axis X-X' with the rotation of the first carrier member 116 and the second carrier member 118.

Moreover, since the first carrier member 116 and the second carrier member 118 hold the at least one rotational output members of the gear assembly 120, the at least one rotational output members of the gear assembly 120 also rotate with respect to the axis X-X' with the rotation of the first carrier member 116, the second carrier member 118 and the jaw assembly 150 In one embodiment, the seventh gear 134 and the eight gear 136 of the gear assembly 120 are carried by the first carrier member 116 and the second carrier member 118, and thus the seventh gear 134 and the eight gear 136 of the gear assembly 120 rotate with the rotation of the first carrier member 116 and the second carrier member 118.

In each of the positions of the first carrier member 116 and the second carrier member 118, i.e., when each of the first carrier member 116 and the second carrier member 118 is in line with the axis X-X' (shown in FIG. 1) of the frame structure 110, and when each of the first carrier member 116 and the second carrier member 118 is rotated to an angle with respect to the axis X-X' (shown in FIG. 5) of the frame structure 110, the at least one rotational output members remains engaged with the at least one rotational input member. In an embodiment, in each of the positions of the first carrier member 116 and the second carrier member 118, different gears of the gear assembly 120 remain engaged.

Such movement of the first carrier member 116 and the second carrier member 118, allows the jaw assembly 150 to reach the fastening elements, such as the clamping rings, locking rings, bolts, cable lugs, and hose clamps etc. that are located in hard to reach places.

Further, the installation tool 100 includes an electronic control unit 178, and an Intuitive User Interface 180 (hereinafter alternatively referred to as IUI 180), as seen in FIG. 4. The IUI 180 comprises a touch display which allows a user to select various parameters of operation. The electronic control unit 178 is adapted to receive inputs based on the close loop system from the driving member 104 and control the operation of the driving member 104 based on the inputs received. The IUI 180 is electronically coupled to the electronic control unit 178. Further, the electronic control unit 178 is adapted to control the driving member 104 in a closed loop in real time to ensure a precise closing of position of the first jaw member 152 and the second jaw member 154 of the jaw assembly 150. In the illustrated example, the electronic control unit 178 can ensure the precise closing of position of the jaw assembly 150 to the tenth of a millimeter. In the illustrated example, the electronic control unit 178 comprises a memory unit (not shown) which stores the preset clamping programs.

The clamping force of the installation tool 180 can be changed using the electronic control unit 178 via the IUI 180. More particularly, the IUI 180 provides an interface to select the clamping force generated between the first holding portion 160 of the first jaw member 152 and the second holding portion 170 of the second jaw member 154. The IUI 180 communicates the input parameters to the electronic control unit 178 and the electronic control unit 178 controls operations based on the input received from the IUI 180. The IUI 180 is enabled to change the initial and final positions of the jaw assembly 150 based on preset clamping programs. The IUI 180 comprises a touch display (not shown) to provide inputs and also to select from preset clamping programs. In an example embodiment, the touch display of the IUI 180 can also be used to create clamping cycles.

During operation of the installation tool 100, as the driving member 104 is powered on, via the switch, the driving member 104 rotates the output member 108, which in turn rotates the first gear 122. The electronic control unit 178 and the IUI 180 may also be used to set various parameters for operating of the installation tool 100. Based on the various parameters, the driving member 104 rotates the output member 108, which in turns rotates first gear 122. The first gear 122, being engaged with the second gear 124 and the fourth gear 128, rotates each of the second gear 124 and the fourth gear 128. The third gear 126 and the fifth gear 130 being mounted on the second gear 124 and the fourth gear 128 respectively, also rotate therewith. The rotation of the third gear 126 and the fifth gear 130 imparts a rotation in the sixth gear 132 and the ninth gear 138 respectively. The rotation of the sixth gear 132 and the ninth gear 138 rotates the seventh gear 134 and the eighth gear 136 which in turn move the first jaw member 152 and the second jaw member 154 via the first toothed engaging portion 164 and the second toothed engaging portion 174 respectively. The movement of the first jaw member 152 and the second jaw member 154 causes movement of the first toothed engaging portion 164 and the second toothed engaging portion 174 between the initial position and the final position.

The movement of the first toothed engaging portion 164 and the second toothed engaging portion 174 enables the first jaw member 152 and the second jaw member 154 to apply a clamping force to hold the fastening elements, such as the clamping rings, locking rings, bolts, cable lugs, and hose clamps etc. Further movement of the first jaw member 152 and the second jaw member 154 from the first position towards the final position causes the first jaw member 152 and the second jaw member 154 to clamp the fastening elements, such as the clamping rings, locking rings, bolts, cable lugs, and hose clamps etc.

Further, since the movement of the first toothed engaging portion 164 and the second toothed engaging portion 174 may be precisely controlled up to one tenth of a millimeter, the amount of clamping force applied by the first jaw member 152 and the second jaw member 154 may also be precisely controlled. Therefore, the clamping force between the first jaw member 152 and the second jaw member 154 is sufficient, but not excessive. Accordingly, the installation tool 100 of the present disclosure, precludes any possibility undesired damage of the fastening elements, such as the clamping rings, locking rings, bolts, cable lugs, and hose clamps etc., by providing a user an option of precisely controlling the clamping force applied by the first jaw member 152 and the second jaw member 154.

Figure 9A:
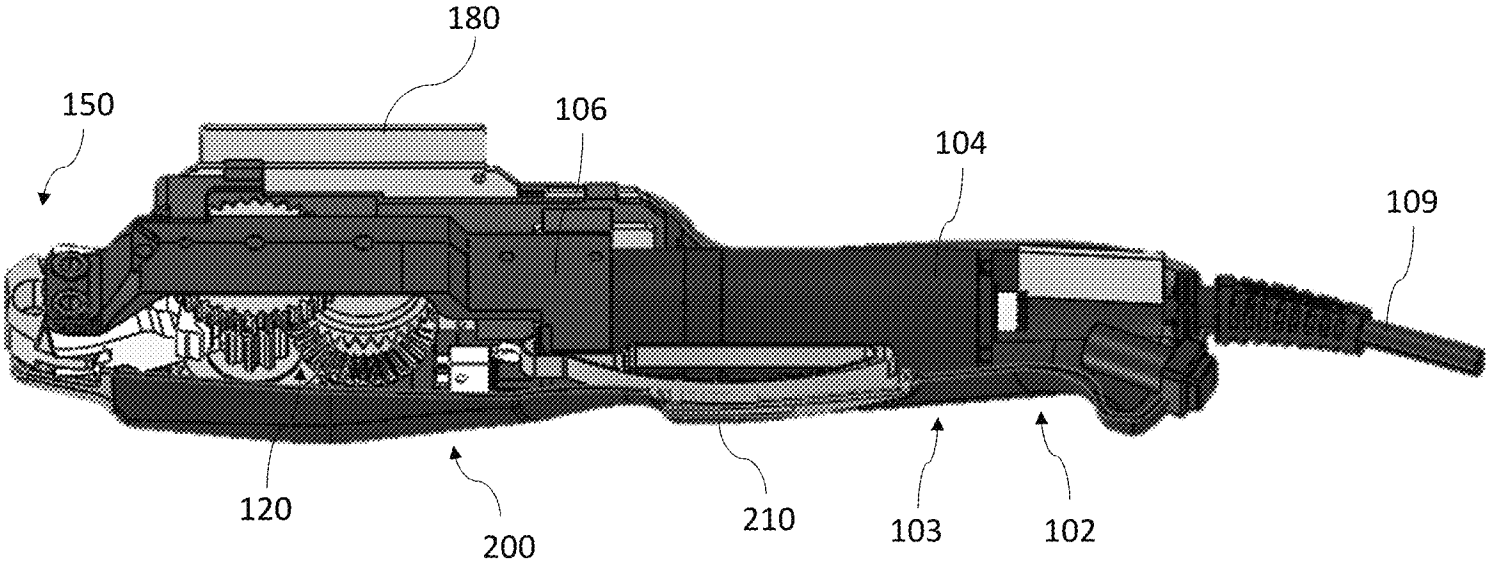
FIGS. 9A, 9B, 9C and 9D illustrate various views of the installation tool in a solid, depicting various components in assembled state within a casing, in accordance with an embodiment of the present invention.
Figure 9B:
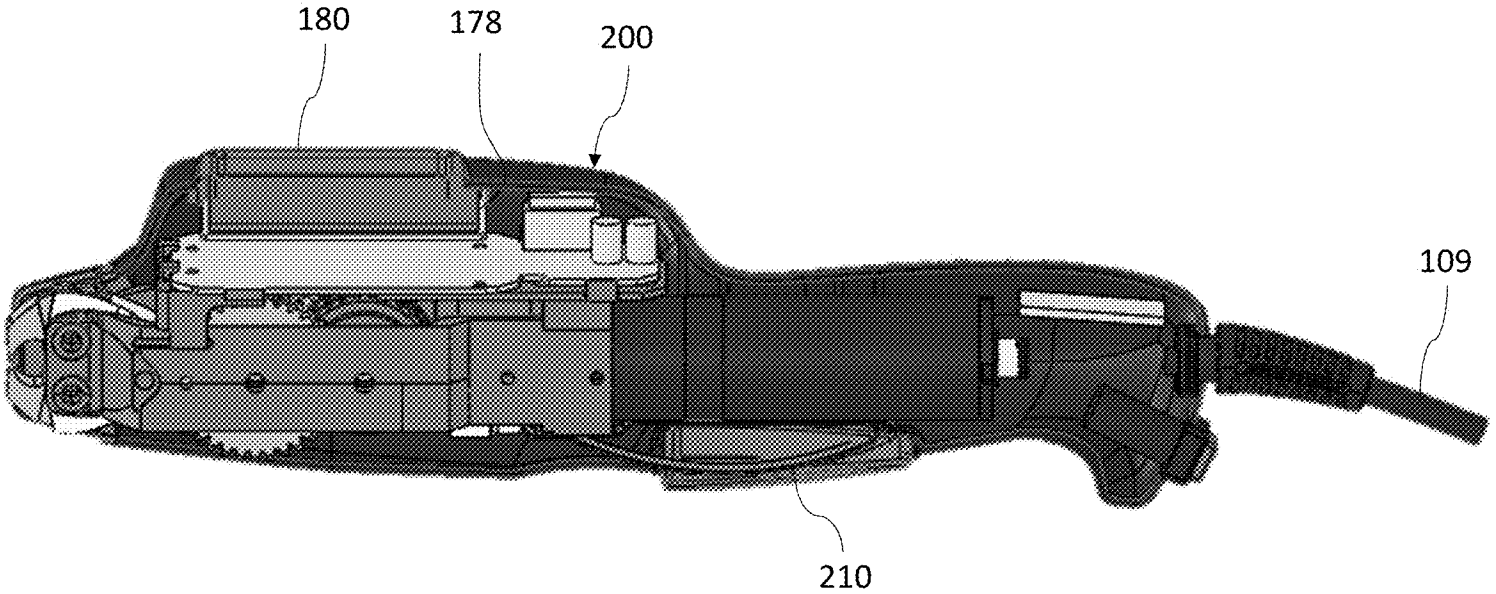
Figure 9C:
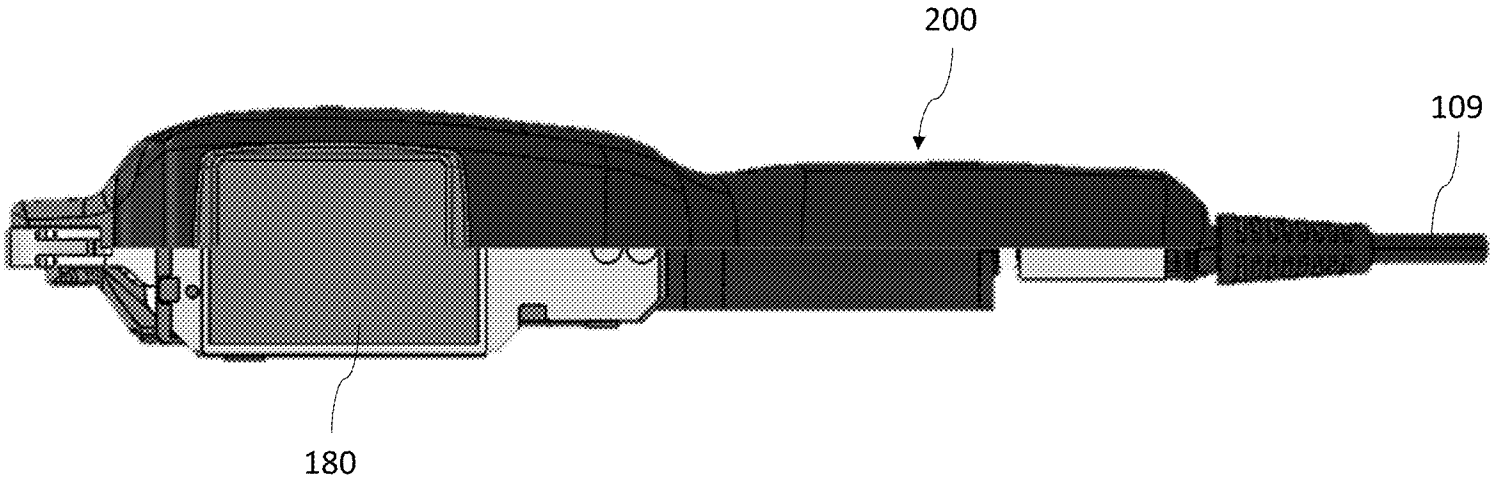
Figure 9D:
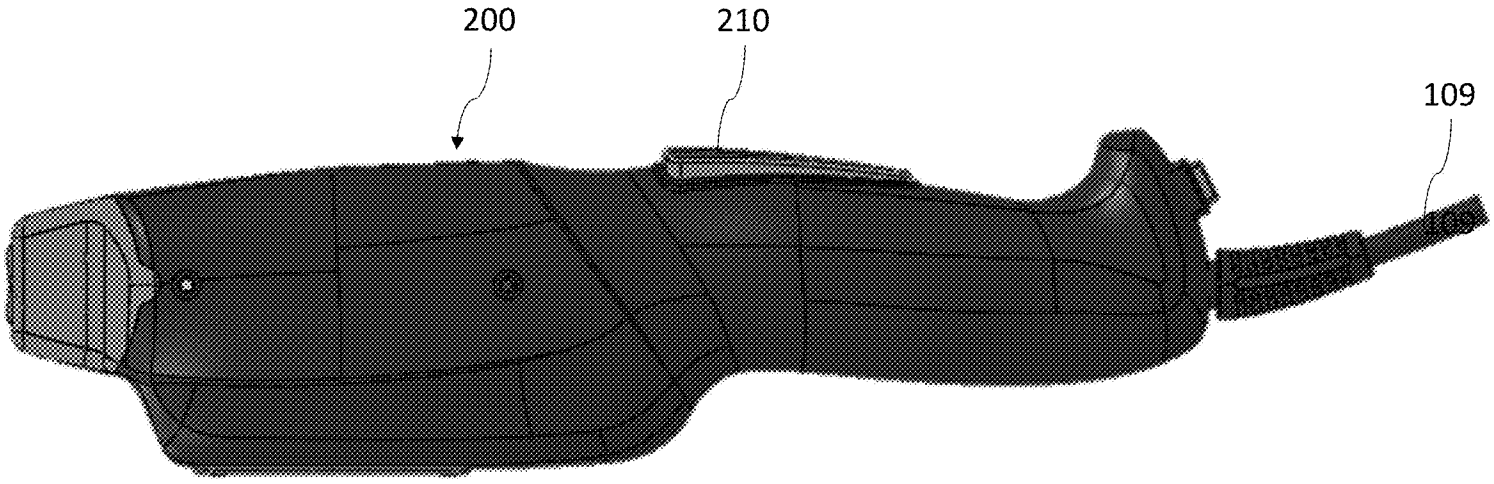

FIGS. 9A, 9B, 9C and 9D illustrate various views of the installation tool in a solid, depicting various components in assembled state within a casing 200, in accordance with an embodiment of the present invention. Specifically, FIGS. 9A and 9B illustrate side isometric views from various plane, wherein the half of casing 200 is disassembled to show internal components as explained above. Further, FIG. 9C illustrates a top view wherein the half of casing 200 is disassembled to show internal components as explained above. Moreover, FIG. 9D illustrates a side view with casing 200. As shown in FIGS. 9A to 9D, the casing includes the handle assembly 102 and the gripping housing 103, from where a user may grip the installation tool 100 and press a button 210 to start thereto, when the cable 109 is plugged in the socket and switch assembly for electric supply. As explained above, the battery may also be used to power the installation tool 100 using the button 210. FIGS. 9A and 9B also depicts the driving member 104, the gear assembly 1200 and the jaw assembly as explained above in great details. FIGS. 9A and 9B also illustrate placement of the IUI 180 along with the electronic control unit 178 in the installation tool 100, in accordance with an exemplary embodiment of the present disclosure. FIG. 9C illustrates the IUI 180 from the top.

The present invention relates to an installation tool 100 for installing/assembling or uninstalling/disassembling of locking rings, bolts, cable lugs, hose clamps, etc., to ensure precise closing position thereof. The installation tool 100 comprises the driving member 104 which is powered by a battery or a low voltage power grid, this eliminates the manual effort to be put in by the user. The installation tool 100 provides a precise closing position of the jaw assembly 150 to the tenth of a millimeter, thereby ensuring that a high clamping force which is sufficient, but not excessive force is generated to clamp the clamp rings, hose clamps etc.

Further, the installation tool 100 is user friendly and easy to transport. The installation tool 100 further provides the graphical intuitive user interface 180 through which a user using the tool may provide inputs and select various modes of operation, create clamping cycles to operate the tool. The installation tool 100 facilitates in clamping the clamp rings which are located in hard to reach places because of the pivoting nature of the carrier members with respect to the frame members.

The gear assembly 120 described herein may comprise any number of gears owing to the requirement of the installation tool 100 and the purpose it is being used for, without limiting the scope of the invention.

As used herein, the phrase "gearably coupled" refers to the meshing of geared teeth to allow a powered gear to drive a non-powered gear.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. An installation tool comprising:

a frame assembly;

a driving member secured to the frame assembly;

a gear assembly operatively coupled to the frame assembly, wherein the gear assembly comprises a plurality of gears configured to receive rotational input from the driving member, wherein the plurality of gears having a first horizontal gear member rotatable along a horizontal axis by the gear assembly, a first vertical arrangement gearably coupled to the first horizontal gear member and rotatable along a first axis perpendicular to the horizontal axis, a second vertical gear arrangement gearably coupled to the first vertical gear arrangement and rotatable along a second axis perpendicular to the horizontal axis and parallel to the first axis; and a jaw assembly operatively coupled to each of the gear assembly and the frame assembly, the jaw assembly comprises a plurality of jaw members having a first jaw member and the second jaw member gearably coupled to the second vertical gear arrangement, and adapted to move between an initial position and a final position thereof, based on the rotational input from the second vertical gear arrangement of the gear assembly driven by the driving member.

2. The installation tool as claimed in the claim 1, wherein the frame assembly comprises a frame structure, and at least one carrier member movably coupled to the frame structure, wherein the at least one carrier member is operatively coupled to the gear assembly and the jaw assembly, and the at least one carrier member is configured to pivotally rotate with respect to the frame structure.

3. The installation tool as claimed in the claim 2, wherein the frame structure comprises a first frame member and a second frame member;

the at least one carrier member comprises a first carrier member and second carrier member spaced apart from each other, the first carrier member rotatably coupled to the first frame member, and the second carrier member rotatably coupled to the second frame member;

a plurality of cross members disposed between space of the first carrier member and the second carrier member;

the first carrier member and the second carrier member along with the plurality of cross members adapted pivotally rotate up to 45 degrees with respect to the first frame member and the second frame member of the frame structure.

4. The installation tool as claimed in claim 1, wherein the first jaw member comprises:

a first holding portion to hold a clamping ring;

a first tooth engaging portion engaged with the gear assembly to move the first holding portion; and a first pivotal portion pivotally couples the first holding portion and the first tooth engaging portion to move the first holding portion based on the movement of the first tooth engaging portion.

5. The installation tool as claimed in claim 4, wherein the second jaw member comprises:

a second holding portion to hold a clamping ring;

a second tooth engaging portion engaged with the gear assembly to move the second holding portion;

a second pivotal portion pivotally couples the second holding portion and the second tooth engaging portion to move the second holding portion based on the movement of the second tooth engaging portion.

6. The installation tool as claimed in the claim 1, wherein the driving member includes at least one output member configured to couple with the gear assembly, wherein the output member comprises:

a driving shaft coupled to the driving member, and a driven shaft rotatably coupled to a driving shaft, wherein the driven shaft is rotatably engaged to the driving shaft to be driven by the driving shaft to transmit rotation and torque produced by the driving member.

7. The installation tool as claimed in the claim 1, wherein the driving member includes an electric motor controlled in a closed loop, and wherein the driving member is electrically driven powered by one of a battery and a low voltage power grid.

8. The installation tool as claimed in the claim 1, further comprises an electronic control unit configured to control the driving member.

9. The installation tool as claimed in the claim 8, further comprises an intuitive user interface in communication with the electronic control unit, wherein the intuitive user interface is adapted to receive user inputs to control the driving member via the electronic control unit.

10. The installation tool as claimed in the claim 9, wherein the intuitive user interface changes the clamping force generated by the jaw assembly.

11. The installation tool as claimed in the claim 10, wherein the intuitive user interface comprises a touch display.

12. The installation tool as claimed in the claim 8, wherein the electronic control unit comprises preset clamping programs which may enable change in initial position and final position of the jaw assembly, wherein the clamping programs are selected or clamping cycles are created using the intuitive graphic interface.

13. An installation tool for operating a clamping ring, said installation tool comprising:

a frame assembly;

a driving member secured to the frame assembly;

a gear assembly operatively coupled to the frame assembly, the gear assembly comprises a plurality of gears arranged to define at least one rotational input receiving member and at least one rotational output member, wherein the at least one rotational input receiving member configured to receive rotational input from the driving member, wherein the plurality of gears having a first horizontal gear member rotatable along a horizontal axis, the first horizontal gear member having a first gear driven by the driving member along the horizontal axis, a first vertical gear arrangement rotatable along a first axis perpendicular to the horizontal axis, the first vertical gear arrangement having a second gear, a third gear, a fourth gear, and a fifth gear, wherein the second gear and the fourth gear are gearably coupled to the first gear to transmit the rotational motion of the first gear along the first axis perpendicular, and wherein the third gear and the fifth gear are respectively engaged with the second gear and the fourth gear to transmit the rotational motion, a second vertical gear arrangement rotatable along a second axis perpendicular to the horizontal axis and parallel to the first axis, wherein the second vertical gear arrangement comprises the sixth gear, the seventh gear, the eighth gear, and the ninth gear, wherein the sixth gear is gearably coupled to the third gear and the ninth gear is gearably coupled to the fifth gear, the seventh gear and the eight gear embodies the at least one rotational output members of the gear assembly; and a jaw assembly operatively coupled to the gear assembly and the frame assembly, wherein the jaw assembly comprises a plurality of jaw members including a first jaw member gearably coupled to the seventh gear, and a second jaw member gearably coupled to the eighth gear, the first jaw member and the second jaw member configured to receive rotational input from the seventh gear and the eighth gear of the at least one rotational output member of the gear assembly to move between an initial position and a final position thereof, wherein the movement between the initial position and the final position of the first and second jaw members as respectively obtained by the seventh and eighth gears is precise up to one tenth of a millimeter, whereby force applied by the first jaw member and the second jaw member on to the clamping ring is sufficient, but not excessive.

14. The installation tool as claimed in the claim 13, wherein the first jaw member and the second jaw member are identical.

15. The installation tool as claimed in the claim 13, further comprises a grip housing adapted to be grasped by a user for controlling said tool, wherein the grip housing encloses the driving member.

16. The installation tool as claimed in the claim 13, wherein the at least one rotational receiving member is a gear.

17. The installation tool as claimed in the claim 13, further comprises an electronic control unit configured to control the driving member.

18. The installation tool as claimed in the claim 17, further comprises an intuitive user interface in communication with the electronic control unit, wherein the intuitive user interface is adapted to receive user inputs to control the driving member via the electronic control unit.

* * * * *